United States Patent [19]

Sievers

[11] 3,940,805

[45] Mar. 2, 1976

[54] SELECTIVE VOLUME FLUSH VALVE

[76] Inventor: William O. Sievers, 512 Milwaukee St., Denver, Colo. 80206

[22] Filed: Aug. 18, 1975

[21] Appl. No.: 605,646

[52] U.S. Cl. ..... 4/67 A; 4/34

[51] Int. Cl.[2] .. E03D 1/34; E03D 5/02; A61B 19/00

[58] Field of Search ..... 4/67 A, 67 R, 34, 249, 4/57 R, 57 P; 137/601

[56] References Cited

UNITED STATES PATENTS

| | | | |
|---|---|---|---|
| 3,406,940 | 10/1968 | Kartell | 4/34 X |
| 3,574,866 | 4/1971 | Sievers | 4/34 |
| 3,619,821 | 11/1971 | Bobo | 4/41 |
| 3,806,962 | 4/1974 | Sievers | 4/67 A |
| 3,902,201 | 9/1975 | Bobo | 4/41 |

*Primary Examiner*—Henry K. Artis

[57] ABSTRACT

A dual capacity flush valve comprises a rotatable valve plate arranged in a sealed housing through which water passes from a supply to the flush outlet. The valve plate has openings which are moved to register with the water outlet and an actuator is provided for vertical movement to either of two open positions of the valve, a downward movement of the actuator for a small quantity flush and an upward movement for a full flush. The flush volume for each position is adjustable. A water motor driven by the flow of flush water returns the valve plate to closed position, stopping its operation when the flow of water is stopped.

18 Claims, 8 Drawing Figures

SELECTIVE VOLUME FLUSH VALVE

This invention relates to automatic valves for delivering predetermined quantities of liquid and particularly to an improved flush valve for toilets and the like which may be operated selectively to deliver either of two quantities of water.

Valves employed in plumbing fixtures are, for some applications, required to deliver a predetermined quantity of water and then to shut off. Automatic valves are employed for such purposes, and, for example, are used as toilet flush valves and as limited delivery valves in public wash rooms to save water by shutting off automatically when a predetermined limited amount of water has been delivered. With a view toward effecting further economy in the use of water, various valve control arrangements have been devised for providing a lower volume flush when the full flush volume is not required. My U.S. Pat. No. 3,806,962, issued Apr. 4, 1972, discloses a dual flush valve for this purpose.

The automatic flush valves commonly used in plumbing systems are single setting valves and two such valves used alternatively may be employed to provide a selectively operated dual capacity flush system. Accordingly, it is an object of my invention to provide an improved automatic flush valve which may be selectively actuated to provide either a full flush or a lesser flush.

It is another object of this invention to provide a flush valve of the dual quantity type including an improved positive acting mechanism for selectively determining the amounts of flush water flow in each of two actuating positions.

It is a further object of my invention to provide a dual capacity flush valve including an improved arrangement utilizing the flow of flush water for effecting the shutting off of the valve.

It is anothe object of my invention to provide an automatic flush valve including an improved and positive acting mechanism which may readily by adjusted to change the quantity of flush water to be delivered.

It is another object of my invention to provide a dual capacity flush valve including an improved actuating mechanism having a single actuator for selecting alternatively either a full capacity flush or a less capacity flush.

It is a further object of my invention to provide an improved dual flush valve having a single actuator and a single valve element for controlling both the full and the partial flush operations.

It is a further object of my invention to provide a single actuator dual capacity flush valve including an improved arrangement for adjusting the volume of water to be delivered in both the full and the partial flush operations.

It is a further object of my invention to provide a flush valve or the like including an improved arrangement for controlling the flow of water therethrough.

It is a still further object of my invention to provide a flush valve or the like including an improved arrangement for adjusting the amount of water to be discharged through the valve on each operation thereof.

Briefly, in carrying out the objects of my invention in one embodiment thereof, I provide a dual volume flush valve unit having a single actuating handle for both flow volumes. The low volume is selected by downward movement of the actuator handle and the full or normal volume is selected by upward movement of the handle. The valve is a rotatable disc having openings which uncover the outlet of the unit; selection of the full volume setting moves the disc to a minimum opening position. The flow of the water actuates a motor which moves the valve disc opening across the outlet until the disc closes the opening. For the low volume setting the valve disc is moved farther so that it leaves less of the opening to be closed, thus permitting less water to flow before the valve is again closed. In this manner the aggregate flow quantity while the outlet is open is less for the low flow condition than for the full flow position. Thus the selected high or low volume setting is effected by the actuator which rotates the disc a selected amount and the volume of the flow is controlled by further rotation of the disc in the same direction to a closed position. Ratchets or one-way clutches prevent reverse movement of the actuator mechanism upon motorized operation of the disc and also allow the actuator handle to return to its neutral or intermediate position when released after its selected actuation. The capacity for each position may be adjusted by changing the amount of movement of the disc which is effected by the actuator.

The features of novelty which characterize my invention are pointed out with particularity in the claims annexed to and forming a part of this specification. My invention itself, however, both as to its organization and its manner of operation, together with further objects and advantages thereof, will best be understood upon reference to the following description taken in connection with the accompanying drawings in which:

Figure 2:
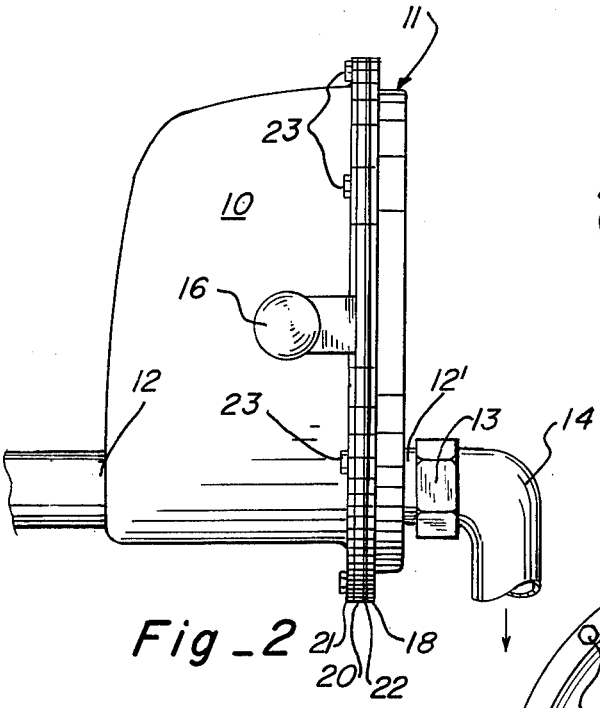
FIG. 2 is an enlarged left side elevation view of the valve.
Figure 1:
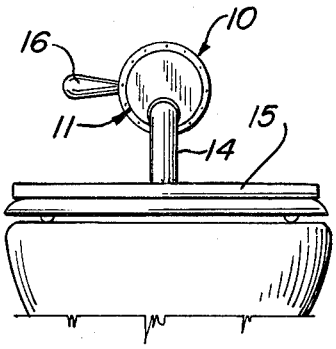
FIG. 1 is a front elevation view of a dual flush valve embodying my invention.
Figure 3:
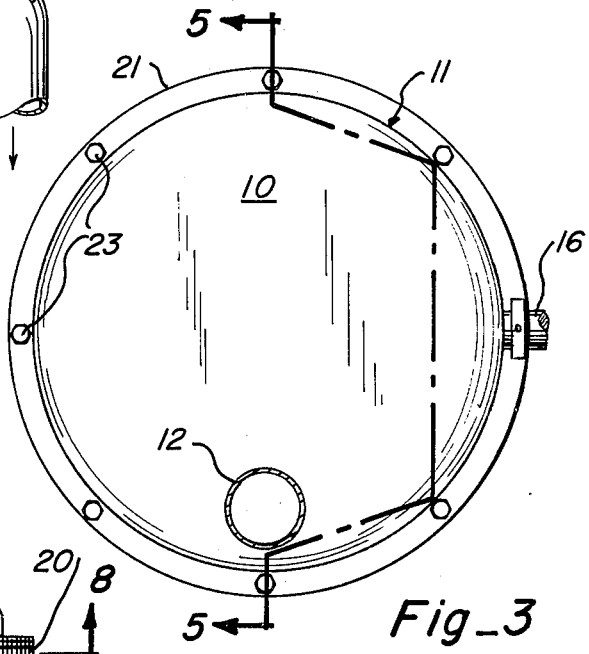
FIG. 3 is a rear elevation view of the valve.

Referring now to the drawings, the dual flush valve shown in FIGS. 1, 2, 3 and 4 comprises a housing 10 and a valve casing or capsule 11 securely mounted on a water supply pipe 12 the outlet from which is indicated at 12'; the outlet is connected through a coupling 13 to the input connection 14 of a plumbing fixture 15 which may be a toilet bowl. The valve is provided with an actuator handle 16 which is moved upwardly for a full or high volume flushing operation and downwardly for a low volume flushing operation.

The capsule 11 includes a dished portion 17 having an outwardly extending flange 18 and a flat plate 20. The housing 10 is provided with an outwardly extending flange 21, and the flanges 18 and 21 with the outer periphery of the plate 20 therebetween are securely clamped together by bolts or machine screws 23. A sealing gasket 22 is provided between the flange 18 and the plate 20.

Figure 5:
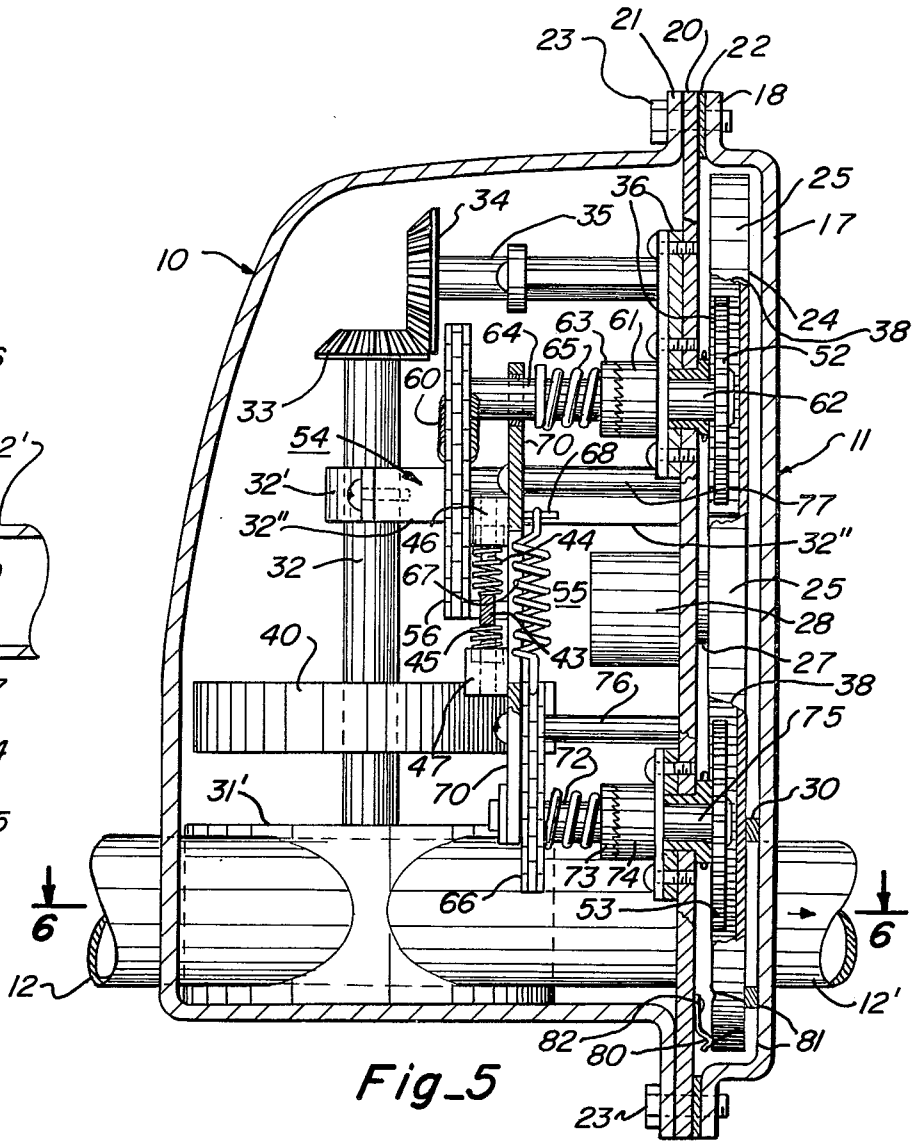
FIG. 5 is an enlarged sectional view of the valve taken along the line 5—5 of FIG. 3.
Figure 6:
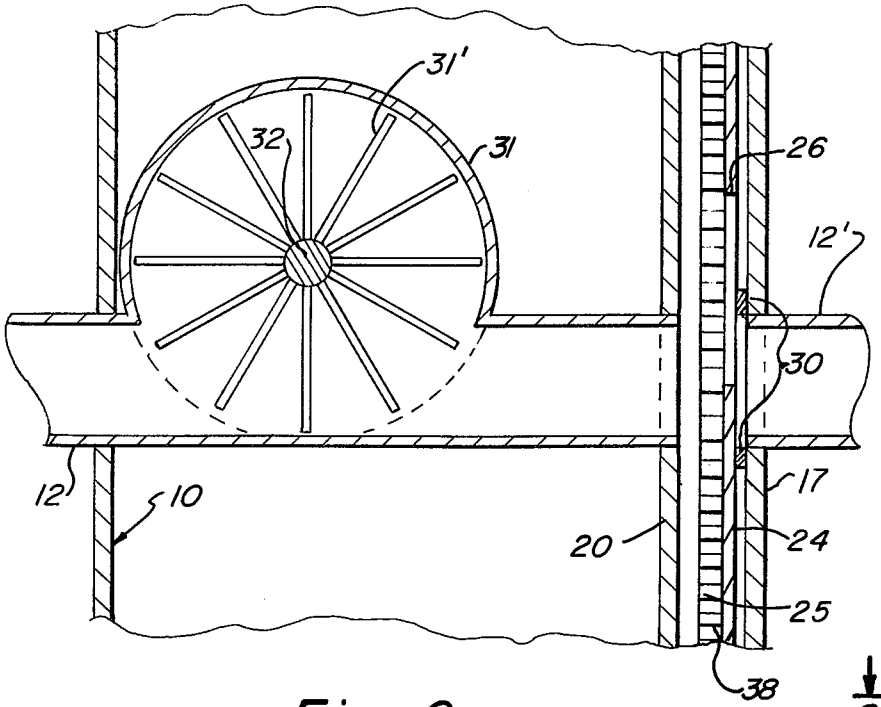
FIG. 6 is a sectional view of a portion of the valve taken along the line 6—6 of FIG. 5.
Figure 7:
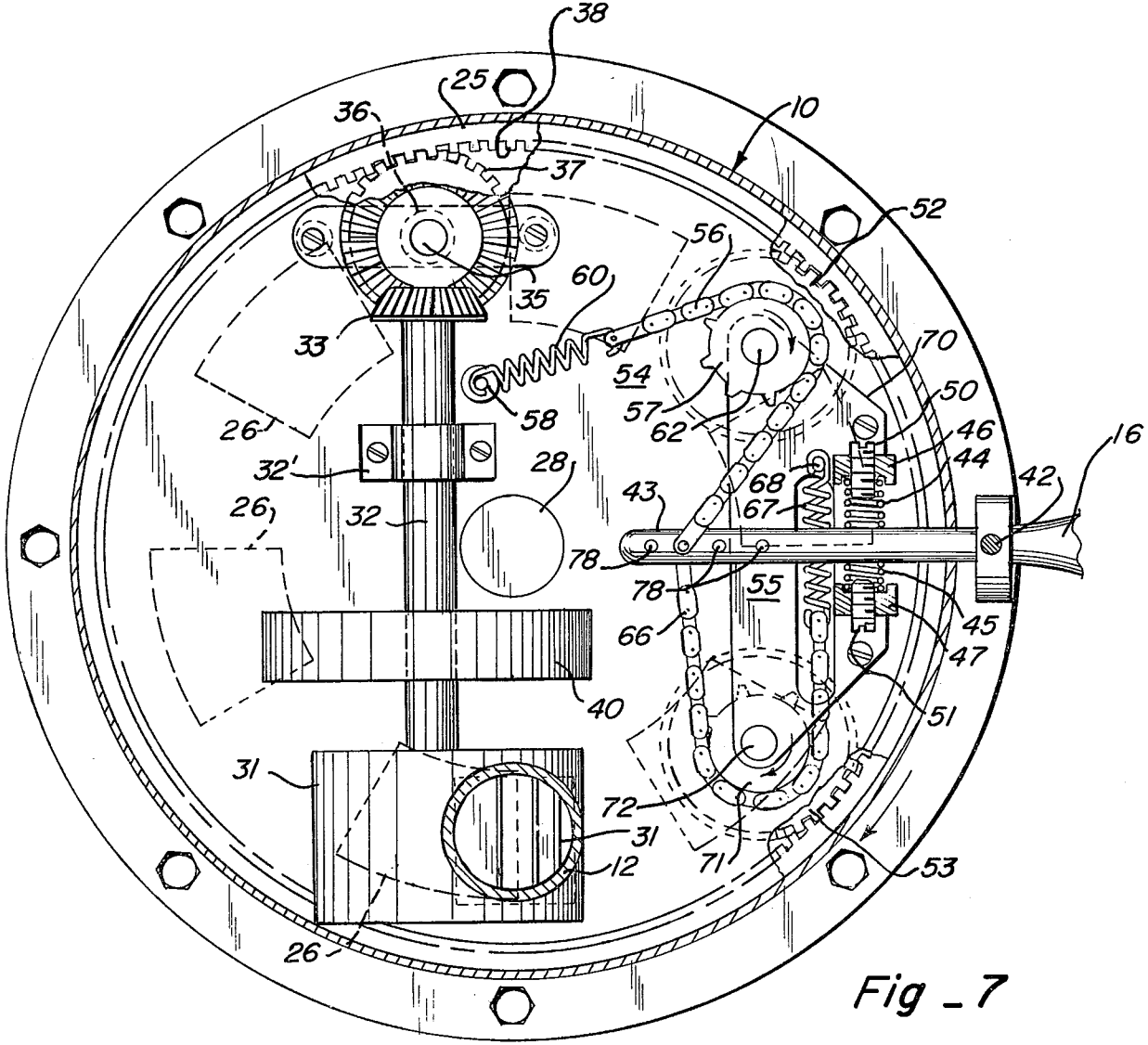
FIG. 7 is a rear view of the valve with the housing removed and the valve closure partly broken away; and, FIG. 8 is a front elevation view of the valve assembly with the capsule removed and showing the position of the outlet as a sectional view thereof.
Figure 8:
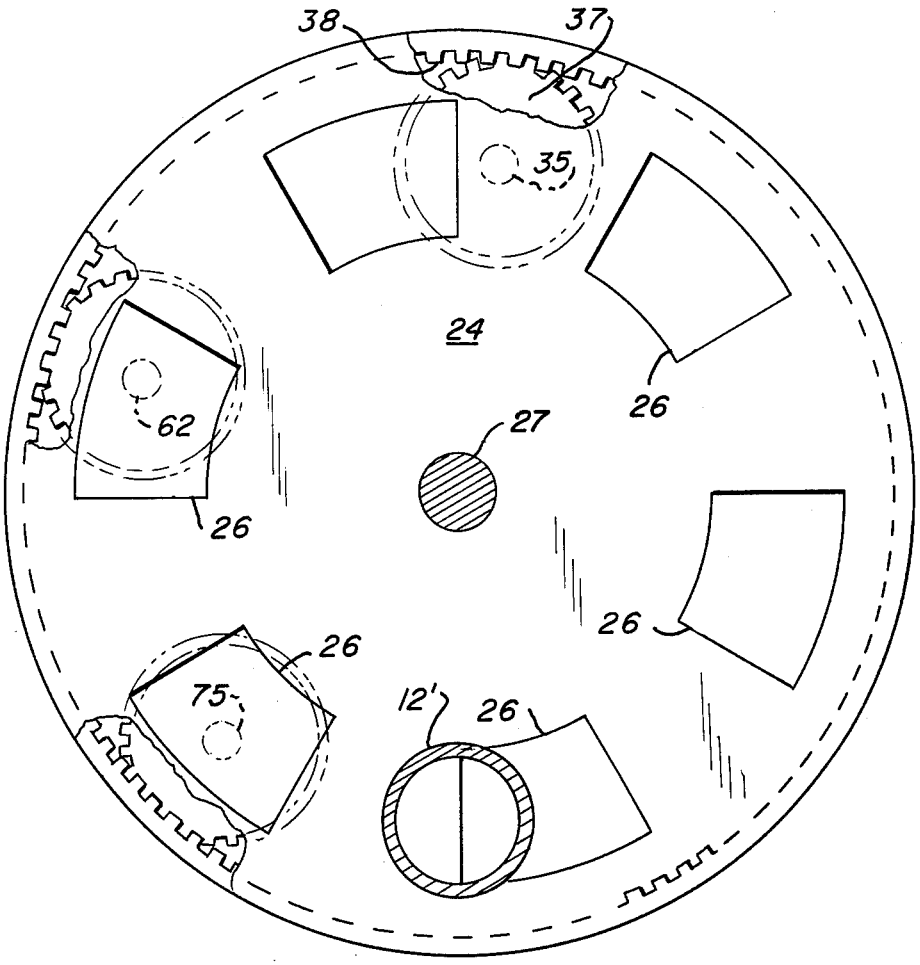

The actuating mechanism of the valve arranged within the housing 10 is illustrated somewhat diagrammaticly in FIGS. 5 through 8. The valve member which controls the passage of water from the inlet 12 to the outlet 12′ is disc 24 which has a peripheral flange 25 extending rearwardly toward the plate 20. The valve disc 24 as shown in FIGS. 7 and 8 has a plurality of openings 26 each of the same size and formed with straight radial edges extending between radially spaced arcuate edges. The openings 26 are spaced at equal angular intervals and the solid portions of the disc between the openings are of sufficient length to extend across and completely close the outlet 12′. In FIGS. 7 and 8 an opening 26 is shown in position to uncover about one half of the area of the outlet. The valve disc 24 is rotatably mounted on a shaft 27 which is freely rotatable within a bearing assembly 28 securely mounted on the plate 20. A sealing ring 30 is monted on the inner surface of the dished portion 17 of the casing 11 about the outlet 12′. The seal frictionally engages the face of the valve disc 24 when any one of the solid portions of the disc is in position to extend across and close the outlet 12′. The disc 24 is connected as described below to be rotated by operation of the handle 16, so that by operation of the handle one of the openings 26 is moved into position with its leading radial edge beyond the near edge of the opening to uncover a portion of the outlet 12′, so that water flows from the inlet 12 to the outlet 12′ through a water motor diagrammatically illustrated as a multi-vaned wheel 31 shown in FIGS. 6 and 7. The wheel 31 is mounted to rotate its shaft indicated at 32 which drives a bevel gear 33. The gear 33 meshes with and drives a bevel gear 34 in a clockwise direction as viewed in FIG. 7; the gear 34 is mounted on a shaft 35 which extends through a water seal bearing 36 and meshes with and drives a gear 37 which meshes with a ring gear 38 provided on the inner side of flange 25 of the disc 24. This drives the ring gear 38 clockwise as viewed in FIG. 7. The shaft 32 turns in a bearing 32′ rigidly supported on a post 32″ which is firmly secured to the plate 20. The wheel 31 of the water motor continues to turn while water is supplied through the conduit 12 until the disc 24 moves sufficiently far that its trailing radial edge reaches the far edge of the opening to close the outlet 12′ whereupon the disc stops. A fly wheel 40 is mounted on the shaft 32 and assures a continuation of the movement of the disc 24 when the flow of water is diminished as the trailing edge approaches the far side of the outlet port 12′ until the outlet port is closed. When the disc stops the outlet 12′ is closed and the pressure of the water within the capsule 11 seals the valve plate 24 against the sealing ring 30. It will be understood that the capsule 11 is filled with water under pressure at all times because the water supply is in open communication with the interior of the capsule as shown in FIG. 6.

As shown in FIG. 7 the actuator handle 16 is pivoted on a shaft 42 and may be moved alternatively either up or down. The handle 16 has a flat elongated arm or extension 43 extending inwardly from the shaft 42. A pair of centering springs 44 and 45 are mounted between the arm 43 and lugs or blocks 46 and 47 and bias the arm 43 and the handle 16 to their central horizontal position. Stops illustrated as screws 50 and 51 are threaded in the blocks 46 and 47, respectively, and may be adjusted to select the predetermined upward and downward movement, respectively, of the arm 43. The springs 44 and 45 have been illustrated diagrammatically and it will be understood that their dimensions are such that they do not interfere with the movement of the arm 43 over the full range of stop settings of the screws.

The handle 16 is arranged to rotate the ring gear 38 in a clockwise direction as viewed in FIG. 7 alternatively through either of two spur gears 52 and 53 which are rotated upon movement of the arm 43 by operation of sprocket wheel and chain assemblies 54 and 55. Assembly 54 comprises a sprocket chain 56 engaging a sprocket wheel 57. The chain 56 is pivotally attached to the arm 43 at one end and to a post 58 at its other end by means of a tensioning spring 60. The post 58 is securely anchored to the flat plate or wall 20 of the capsule 11 and extends from the plate at right angles to its position for engagement with the spring 60. When the handle 16 is lifted, chain 56 is pulled downwardly against the tension of the spring 60 and rotates the sprocket gear 57 in a clockwise direction, thereby driving the ring gear 38 clockwise by rotation of the spur gear 52. As shown in FIG. 5, the positive drive of the spur gear is effected through a ratchet type clutch having a driven element 61 connected to the shaft 62 of the gear 52 and an element 63 which is longitudinally slidable, but not rotatable, on the sprocket gear shaft 65 and is pressed toward the element 61 by a spring 64. On release of the arm 43 and its return to its center position, the ratchet affords relative rotation between the shaft 65 of the sprocket gear 60 and the shaft 62 of the spur gear 52. Thus the sprocket is returned to its position under bias of the spring 64.

In a similar manner the sprocket chain gear assembly 55 as shown in FIGS. 5 and 7 comprises a chain 66 pivotally connected at one end to the arm 43 and connected at its other end to a spring 67 which engages a pin 68 which projects outwardly or laterally from a mounted plate or support 70. The sprocket wheel of the assembly 55 indicated at 71 is mounted on a shaft 72 and drives the spur gear 53 through a ratchet clutch comprising a slidable, but not rotatable, element 73 and an engaging element 74 which is secured to a shaft 75 of the spur gear 53. When the handle 16 is moved downwardly the arm 43 moves upwardly and drives the chain 66 upwardly to rotate the gear 71 in a clockwise direction and thereby drives the ring gear 38 in a clockwise direction by rotation of the spur gear 55. Upon release of the handle 16 the sprocket chain 66 is returned to its initial position to which it is biased by the spring 67.

As illustrated in FIG. 7, the stops 50 and 51 have been adjusted so that on downward movement of the handle 16 the arm 43 rotates upwardly a greater distance or angle than it may move downwardly upon upward movement of the handle 16, the stop 51 being positioned nearer to the central position of the arm 43 than the stop 50.

The mounting platae 70 is rigidly supported in spaced relationship to the plate 20 on a plurality of posts, two of which are shown at 76 and 77 in FIG. 5. In addition, the plate 70 carries the outer bearings for the shafts 64 and 72 of the gears 52 and 53, respectively. The blocks 46 and 47 are secured to the plate 70. The sprocket chain assemblies 54 and 55 are mounted on opposite sides of the plate 70 and are pivoted to the arm 43 on opposite sides.

In the operation of the flush valve when the handle 16 is pressed downwardly the sprocket chain 66 moves up to rotate the gear 53 a distance sufficient to move the plate so that a portion of the solid area of the plate between two openings 26 covers, say, one-half of the discharge opening 12'. The flow of water activates the motor 31 and drives the ring gear 38 in a clockwise direction and when the solid portion of the disc has covered the remainder of the oulet 12' the water is shut off and the ring gear stopped. When the handle 16 is released the sprocket gear 71 returns to its initial position by rotation independent of the gear 53 because of the ratchet action of the member 73 and 74.

In a similar manner, if the handle 16 is raised, it results in a movement of the ring gear 38 through a lesser angular distance as determined by the setting of the stop 51. Thus the solid portion of the disc 24 betwen two openings may be brought to a position such that the moving edge moves slightly past the edge of the opening 12' at the end of the movement produces by the handle 16. Thus the disc must move over substantially the entire angle determined by the size of the opening before the water is again shut off by the closing of the following edge of the opening when it reaches the far side of the outlet 12'.

Access to the interior of the housing 10 is attained by removing the screws 23 and drawing the cover away from the capsule 11 back along the straight inlet pipe, a suitable slot to accommodate movement past the handle being provided on the housing. After removal of the housing the control within the housing may be adjusted or otherwise serviced. For close quarter installations the housing may be made in two parts bolted together along the center horizontal plane of the pipe 12 to afford ready release of the housing after movement away from the handle.

Figure 4:
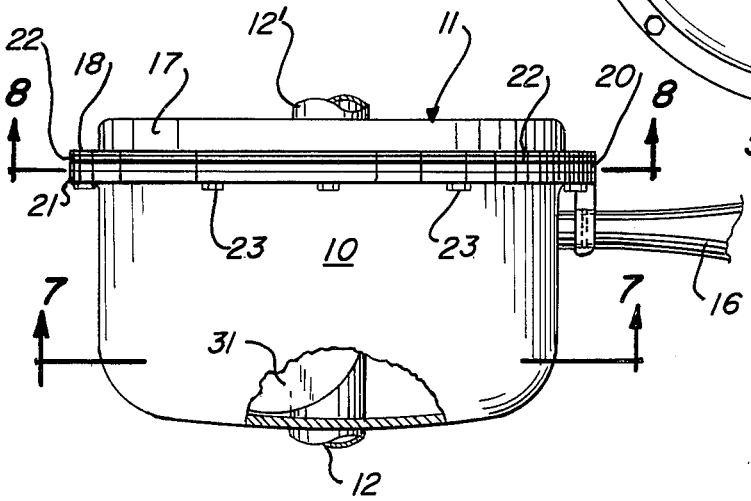
FIG. 4 is a top plan view partly broken away.

For some applications it may be desirable to provide a more positive stop position for the disc 24 and a detent 80 and sloping sided recess 81 has been shown in the lower portion of FIG. 4, the detent 80 being secured to the plate 20 in any suitable manner at 82 and the detent being positioned to engage the recess 81 when the valve disc 24 moves to a position in which the solid area of the disc between two openings has closed the opening 12'. A plurality of recesses 81 are provided one for each of the openings 26 so that the detent enters the corresponding recess for each of the openings. The detent is effective when the water flow has decreased to a minimum and holds the disc in position ready for the next operation of the handle or actuator 16 which releases the detent by a movement of the disc 24.

The adjustment of the relative flows between the high volume flow and the low volume flow may be made by removing the housing for access and changing the positions of the screws 50 and 51, and in some cases by changing the point of connection of the sprocket chains to the arm 43 provides a wide range of adjustment so that a quantity of flow for each of the positions of the handle 16 may be selected as desired. The provision of the low volume flow for a large portion of the number of operations of the valve acts to save water by decreasing the use of water in excess of that required.

While I have described my invention in connection with a specific partially diagrammatic arrangement, various modifications and arrangements will occur to those skilled in the art. I do not therefore desire my invention to be limited to the details shown and described, and I intend by the appended claims to cover all modifications which fall within the spirit and scope of my invention.

I claim:

1. An automatic flush valve for delivering a predetermined amount of water upon each acutation thereof comprising a closed casing having an inlet for water under pressure and an outlet, a valve comprising a plate for closing said outlet mounted for sliding movement across said outlet and having an opening therethrough movable into alignment with said outlet for affording the passage of water through said outlet, said opening having a leading edge and a trailing edge, actuator means for sliding said plate from its outlet closing position a predetermined distance across said outlet to a position wherein said leading edge has moved to effect a partial opening of said outlet, and driving means dependent upon the resulting passage of water through said valve for sliding said plate in the same direction as by said actuator means until said trailing edge passes said outlet to close said valve and stop the flow of water.

2. An automatic flush valve as set forth in claim 1 having means for restoring said actuator to its starting positon upon release.

3. An automatic flush valve as set forth in claim 1 having adjustable means for selecting said predetermined distance of movement of said plate by said actuator.

4. An automatic flush valve as set forth in claim 1 wherein said plate is a rotatable disc, said disc having means utilizing inlet water pressure for sealing said outlet and preventing the flow of water through said outlet when said valve is closed.

5. An automatic flush valve as set forth in claim 1 wherein said driving means is a water motor having a rotor arranged in the path of the water flowing toward said outlet and means utilizing the rotation of said rotor to drive said plate.

6. An automatic flush valve as set forth in claim 5 having a flywheel on the shaft of said rotor for continuing the rotation of said valve when said opening approaches its closing position and the rate of flow of water has been reduced thereby.

7. An automatic flush valve as set forth in claim 4 having a ring gear on said rotatable disc;

a pair of drive gears meshing with said ring gear;

means for connecting said actuator and said gears for rotating one of said gears in a predetermined direction upon movement of said actuator in one direction and for moving the other of said gears in the same direction upon movement of said actuator in a direction opposite said predetermined direction; and, means for effecting a greater opening of said valve on movement of said actuator in said one direction than on movement in the opposite direction.

8. An automatic flush valve as set forth in claim 7, each of said gears having a shaft, two sprocket wheels, each in axial alignment with a respective one of said shafts, and two chains, each engaging a respective one of said sprockets, means biasing both said sprocket wheels to starting positions in the same direction of rotation, said actuator being connected to said chains for pulling said chains alternatively against their respective biasing means for rotating the selected gear to move said disc, and overrunning means for preventing the rotation of each of said gears by the relative movement of its respective sprocket to its starting position by operation of said biasing means.

9. A dual capacity flush vlave comprising a closed casing having a water inlet and a water outlet, a valve member movable from a fully closed position to a fully open position, means providing a water passage between said inlet and said outlet and a water motor positioned within said passage for rotation by water passing therethrough, means connecting said motor to drive said valve member in a predetermined direction, an actuator for selectively moving said valve member to a first open position and alternatively to a second more open position, said actuator upon moving said valve member to either of said positions effecting the supplying of water to said motor for driving said valve member to its closed position whereby movement of said member to said first position allows a greater volume of water to flow before closing said valve than that resulting from the movement of said valve member to said second position.

10. A dual capacity flush valve as set forth in claim 9 wherein said valve member is a circular disc having at least one opening aligned with said outlet for opening said outlet upon movement of said opening to either of said positions, and wherein said motor and said actuator are connected to rotate said disc in the same direction.

11. A dual capacity flush valve as set forth in claim 9 wherein said actuator comprises a pivoted handle movable to either of two opposite positions, and adjustable stop means for limiting the movement of said handle toward each respective position.

12. A dual capacity flush valve as set forth in claim 10 wherein said disc has a ring gear thereon and including three drive gears, the first and second of said drive gears being connected to be rotated by said actuator in the same direction by operation of said actuator in respective ones of said actuator positions and the third of said gears being connected to be driven by said motor, and respective overrunning clutches for each of said first and second gears to afford driving of said first and second gears by said motor independently of said actuator.

13. A dual capacity fluch valve comprising means providing an inlet for water under pressure and an outlet, a rotatable valve member positioned between said inlet and said outlet and having an opening therethrough for controlling the flow of water from said inlet to said outlet, a closed casing for said rotatable member, a valve actuator movable alternatively to either of two flush actuating positions, means connecting said actuator and said rotatable valve for effecting rotation of said valve in the same direction on movement of said valve to either of said positions, movement of said valve to one of said positions opening said valve a first predetermined amount and to the other of said positions to a second and greater predetermined amount, and power means dependent upon a flow of water from said inlet to said outlet for rotating said valve in the same direction to close said valve, the aggregate amount of water flowing to said outlet being greater for said one position of said valve than for said other position.

14. A dual capacity flush valve as set forth in claim 13 wherein the valve member is a rotatable disc, said disc having means utilizing inlet water pressure for sealing said outlet and preventing the flow of water through said outlet when said valve is closed.

15. A dual capacity flush valve as set forth in claim 13 wherein said power means in a water motor having a rotor arranged in the path of the water flowing toward said outlet and means utilizing the rotation of said rotor to drive said rotatable valve.

16. A dual capacity flush valve as set forth in claim 15 having a flywheel on the shaft of said rotor for continuing the rotation of said valve when said opening approaches its closing position and the rate of flow of water has been reduced thereby.

17. A dual capacity flush valve as set forth in claim 14 having a ring gear on said valve disc;

a pair of drive gears meshing with said ring gear;

means for connecting said actuator and said gears for rotating one of said gears in a predetermined direction upon movement of said actuator in one direction and for moving the other of said gears in the same direction upon movement of said actuator in a direction opposite said predetermined direction; and, means for effecting a greater opening of said valve on movement of said actuator in said one direction than on movement in the opposite direction.

18. A dual capacity flush valve as set forth in claim 17, each of said gears having a shaft, two sprocket wheels, each in axial alignment with a respective one of said shafts, and two chains, each engaging a respective one of said sprockets, means biasing both said sprocket wheels to starting positions in the same direction of rotation, said actuator being connected to said chains for pulling said chains alternatively against their respective biasing means for rotating the selected gear to move said disc, and overrunning means for preventing the rotation of each of said gears by the relative movement of its respective sprocket to its starting position by operation of said biasing means.

* * * * *